US005970716A

United States Patent [19]

Forrester et al.

[11] Patent Number: 5,970,716

[45] Date of Patent: Oct. 26, 1999

[54] APPARATUS FOR RETAINING CENTERBODY BETWEEN ADJACENT DOMES OF MULTIPLE ANNULAR COMBUSTOR EMPLOYING INTERFERENCE AND CLAMPING FITS

[75] Inventors: James M. Forrester, Springboro; Gregory A. Cimmarusti; David B. Legger, both of Mason; James N. Cooper, Hamilton, all of Ohio; Robert J. Albers, Park Hills, Ky.

[73] Assignee: General Electric Company, Cincinnati, Ohio

[21] Appl. No.: 08/942,741

[22] Filed: Oct. 2, 1997

[51] Int. Cl.[6] ..... F23R 3/50

[52] U.S. Cl. ..... 60/746; 60/39.32; 60/747

[58] Field of Search ..... 60/39.31, 39.32, 60/39.36, 39.37, 746, 747, 748; 431/154

[56] References Cited

U.S. PATENT DOCUMENTS

| | | | |
|---|---|---|---|
| 4,016,718 | 4/1977 | Lauck et al. | 60/39.37 |
| 4,767,137 | 8/1988 | Zinner et al. | 285/325 |
| 5,197,289 | 3/1993 | Glevicky et al. | 60/746 |
| 5,220,795 | 6/1993 | Dodds et al. | 60/747 |
| 5,241,827 | 9/1993 | Lampes | 60/754 |
| 5,279,112 | 1/1994 | Halila | 60/39.094 |
| 5,289,687 | 3/1994 | Kress et al. | 60/747 |
| 5,323,604 | 6/1994 | Ekstedt et al. | 60/39.36 |
| 5,375,420 | 12/1994 | Falls et al. | 60/747 |
| 5,417,069 | 5/1995 | Alary et al. | 60/747 |
| 5,421,158 | 6/1995 | Stenger et al. | 60/747 |
| 5,524,430 | 6/1996 | Mazeaud et al. | 60/39.31 |
| 5,598,696 | 2/1997 | Stotts | 60/39.32 |
| 5,641,267 | 6/1997 | Proctor et al. | 415/173.1 |

*Primary Examiner*—Ted Kim

*Attorney, Agent, or Firm*—Andrew C. Hess; Rodney M. Young

[57] ABSTRACT

A double annular combustor having concentrically disposed inner and outer annular combustors including an inner dome having an inner portion and an outer portion, an outer dome having an inner portion and an outer portion, wherein the outer dome inner portion is connected to the inner dome outer portion, and a substantially annular centerbody disposed between the inner dome and the outer dome. The centerbody includes a plurality of structurally independent arcuate segments, wherein each centerbody segment is retained in position via an interference fit between a first flange of such centerbody extending downstream and a hook in the inner dome outer portion and/or via a clamping fit of a second flange of the centerbody extending upstream to a flange of the inner dome outer portion.

18 Claims, 6 Drawing Sheets

APPARATUS FOR RETAINING CENTERBODY BETWEEN ADJACENT DOMES OF MULTIPLE ANNULAR COMBUSTOR EMPLOYING INTERFERENCE AND CLAMPING FITS

BACKGROUND OF THE INVENTION

1. Field of the Invention

The present invention relates generally to multiple annular combustors for a gas turbine engine and, in particular, to the manner of retaining a centerbody in position between adjacent domes of such multiple annular combustors.

2. Description of Related Art

Efforts to reduce emissions in gas turbine engines have brought about the use of staged combustion techniques wherein one burner or set of burners is used for low speed, low temperature conditions such as idle, and another, or additional, burner or burners are used for high temperature operating conditions. One particular configuration of such a concept is that of the double annular combustor wherein the two stages are located concentrically in a single combustor liner. Conventionally, the pilot stage section is located concentrically outside and operates under low temperature and low fuel/air ratio conditions during engine idle operation. The main stage section, which is located concentrically inside, is later fueled and cross-ignited from the pilot stage to operate at the high temperature and relatively high fuel/air ratio conditions. The swirl cups of the respective pilot and main stage sections generally lie in the same radial and circumferential planes, as exemplified by U.S. Pat. No. 4,292,801 to Wilkes et al. and U.S. Pat. Nos. 4,374,466 and 4,249,373 to Sotheran.

However, as discussed in a development report to the National Aeronautics and Space Administration (NASA) on combustion system component technology for the Energy Efficient Engine ($E^3$) and U.S. Pat. No. 4,194,358 to Stenger, the pilot stage and the main stage may be radially offset (i.e., lie in distinct radial planes). In both the '358 patent and $E^3$ configurations, the effective length of the main stage section is relatively short and the effective length of the pilot stage section is relatively long.

This configuration allows for complete or near-complete combustion to reduce the amount of hydrocarbon and carbon monoxide emissions since there is a relatively long residence time in the pilot stage section and a relatively minimal residence time in the main stage section.

Whether the inner and outer combustors are radially aligned or not, and whether the outer annular combustor acts as the pilot stage or main stage, the prior art discloses the use of a centerbody between the pilot and main stages. The intended purpose of such centerbodies is to isolate the pilot stage from the main stage in order to ensure combustion stability of the pilot stage at various operating points and to allow primary dilution air to be directed into the pilot stage reaction zone.

Until recently, such centerbodies have been a continuous ring fabricated from forged or rolled rings and sheet material. Such one-piece designs were difficult to manufacture due to tight size and form tolerance requirements for fabrication and assembly. Moreover, the difference in temperature between the combustor structure and the centerbody generated large hoop stresses and associated forces at the point of attachment. In order solve these and other problems stemming from one-piece centerbody designs, a centerbody has been developed which is made up of a plurality of independent arcuate segments which are connected to either the inner or outer domes of the combustor (see U.S. Pat. No. 5,375,420 to Falls et al.).

Centerbodies in general and centerbody segments in particular have previously been attached to the inner and/or outer domes of the combustor through a bolted connection or brazing. Since the centerbody is located in a hostile environment in which the flame temperatures approach ideal stoichiometric reaction (4000° F.), the life of this component is limited due to the eventual oxidation of the metal (despite cooling air and thermal barrier coatings used to protect the parent metal from the extreme temperatures). Because the prior methods of attaching the centerbody segments to the combustor have made it difficult to replace such segments in the field, it would be desirable if a new manner of attaching them would be developed that would allow the engine user to more easily maintain the combustor. Accordingly, the present invention provides a new way of retaining the centerbody segments in position between the inner and outer domes of a combustor which facilitates the insertion and removal thereof.

SUMMARY OF THE INVENTION

In accordance with the present invention, a double annular combustor having concentrically disposed inner and outer annular combustors is disclosed. The double annular combustor includes an inner dome having an inner portion and an outer portion, an outer dome having an inner portion and an outer portion, wherein the outer dome inner portion is connected to the inner dome outer portion, and a substantially annular centerbody disposed between the inner dome and the outer dome. The centerbody includes a plurality of structurally independent arcuate segments, wherein each centerbody segment is retained in position via an interference fit between a first flange of such centerbody extending downstream and a hook in the inner dome outer portion and/or via a clamping fit of a second flange of the centerbody extending upstream to a flange of the inner dome outer portion.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
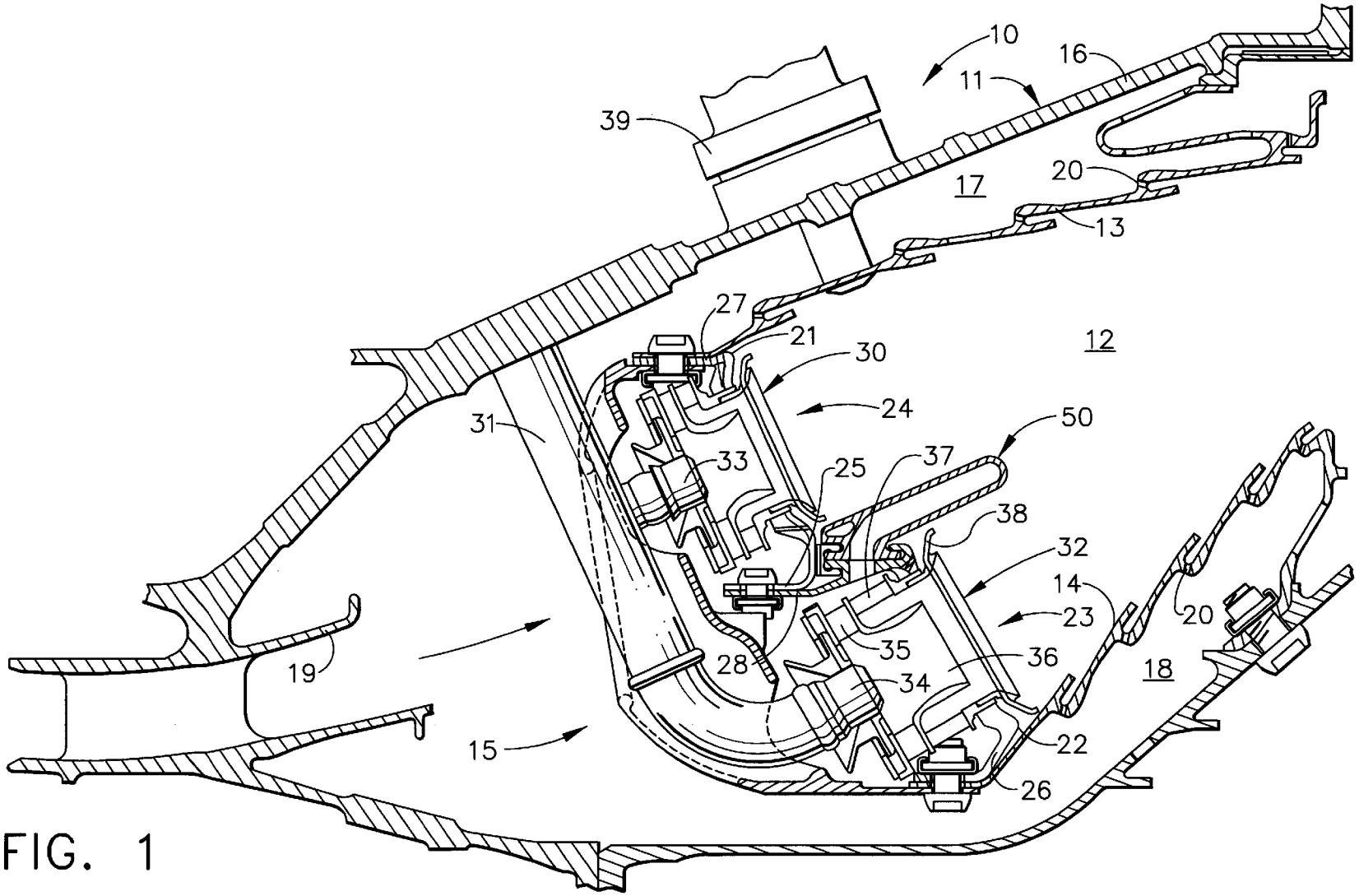
FIG. 1 is transverse cross-sectional view of a double annular combustor in accordance with a preferred embodiment of the invention.

Referring now to the drawings in detail, wherein identical numerals indicate the same elements throughout the figures, FIG. 1 depicts a continuous-burning combustion apparatus 10 of the type suitable for use in a gas turbine engine and comprising a hollow body 11 defining a combustion chamber 12 therein. Hollow body 11 is generally annular in form and is comprised of an outer liner 13 and an inner liner 14. At the upstream end of the hollow body 11 is a series of openings 15 for the introduction of air and fuel in a preferred manner as will be described hereinafter.

The hollow body 11 may be enclosed by a suitable shell 16 which, together with liners 13 and 14, defines outer passage 17 and inner passage 18, respectively, which are adapted to deliver in a downstream flow the pressurized air from a suitable source such as a compressor (not shown) and a diffuser 19. The compressed air from diffuser 19 passes principally into annular opening 15 to support combustion and partially to passages 17 and 18 where it is used to cool liners 13 and 14 by way of a plurality of apertures 20 and to cool the turbomachinery further downstream.

Disposed between and interconnecting outer and inner liners 13 and 14 near their upstream ends, are outer and inner domes 21 and 22, respectively, which preferably are separate and distinct dome plates attached to the liners by way of bolts, brazing or the like. Outer and inner dome plates 21 and 22 each have inner portions 25 and 26 and outer portions 27 and 28, respectively. Accordingly, outer dome plate outer portion 27 is connected to outer liner 13 and inner dome plate inner portion 26 is connected to inner liner 14. Outer dome inner portion 25 is connected to inner dome outer portion 28 as described hereinafter.

Dome plates 21 and 22 are arranged in a so-called "double annular" configuration wherein the two form the forward boundaries of separate, radially spaced, annular combustors which act somewhat independently as separate combustors during various staging operations. For purposes of description, these annular combustors will be referred to as the inner annular combustor (main stage section) 23 and outer annular combustor (pilot stage section) 24, and will be more fully described hereinafter.

Figure 3:
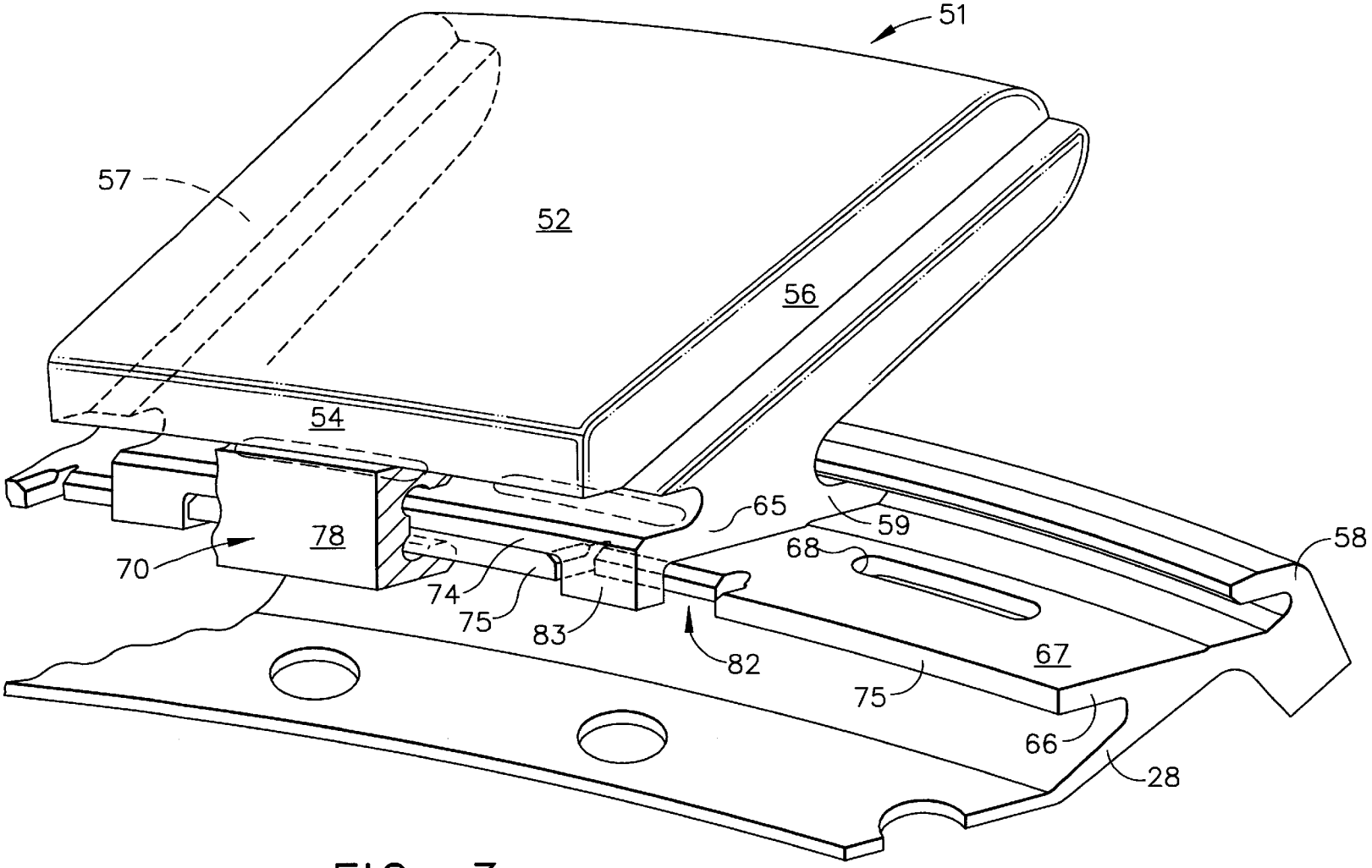
FIG. 3 is a partial forward looking aft perspective view of the combustor depicted in FIGS. 1 and 2, where the outer dome has been removed for clarity.

Located between inner annular combustor 23 and outer annular combustor 24 in the preferred embodiment of FIG. 1 is a centerbody 50 which acts to separate, as well as partially define the common boundary between inner and outer annular combustors 23 and 24, respectively. Centerbody 50 conducts the flow of air rearwardly to restrain the combustive gases of inner annular combustor 23 from entering outer annular combustor 24 and vice versa. As will be seen in FIG. 3 of U.S. Pat. No. 5,375,420 to Falls et al., which is also owned by the assignee of the present invention and hereby incorporated by reference, centerbody 50 preferably is divided into a plurality of arcuate segments 51 having equal circumferential length. It should be noted that each segment 51 of centerbody 50 preferably has a top portion 49 with an upper wall 52, a lower wall 53, an upstream wall 54, a downstream end 55, and a pair of side walls 56 and 57 (preferably flanged as seen in FIG. 3), with an interior chamber defined therein. It will be understood that cooling holes are provided in upper wall 52, lower wall 53, side walls 56 and 57, and downstream end 55 as is known in the art.

Figure 2:
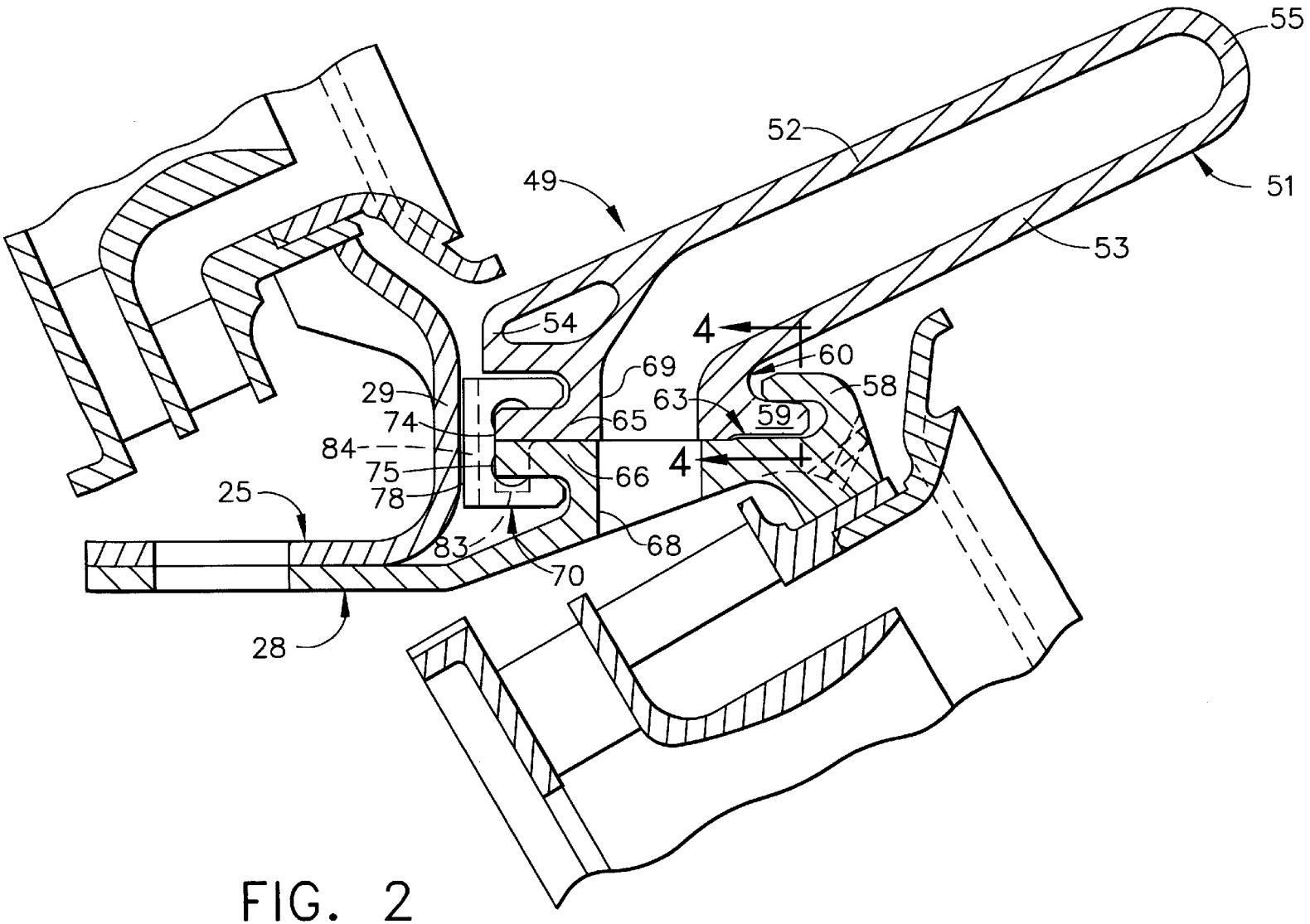
FIG. 2 is an enlarged partial view of the combustor depicted in FIG. 1.
Figure 4:
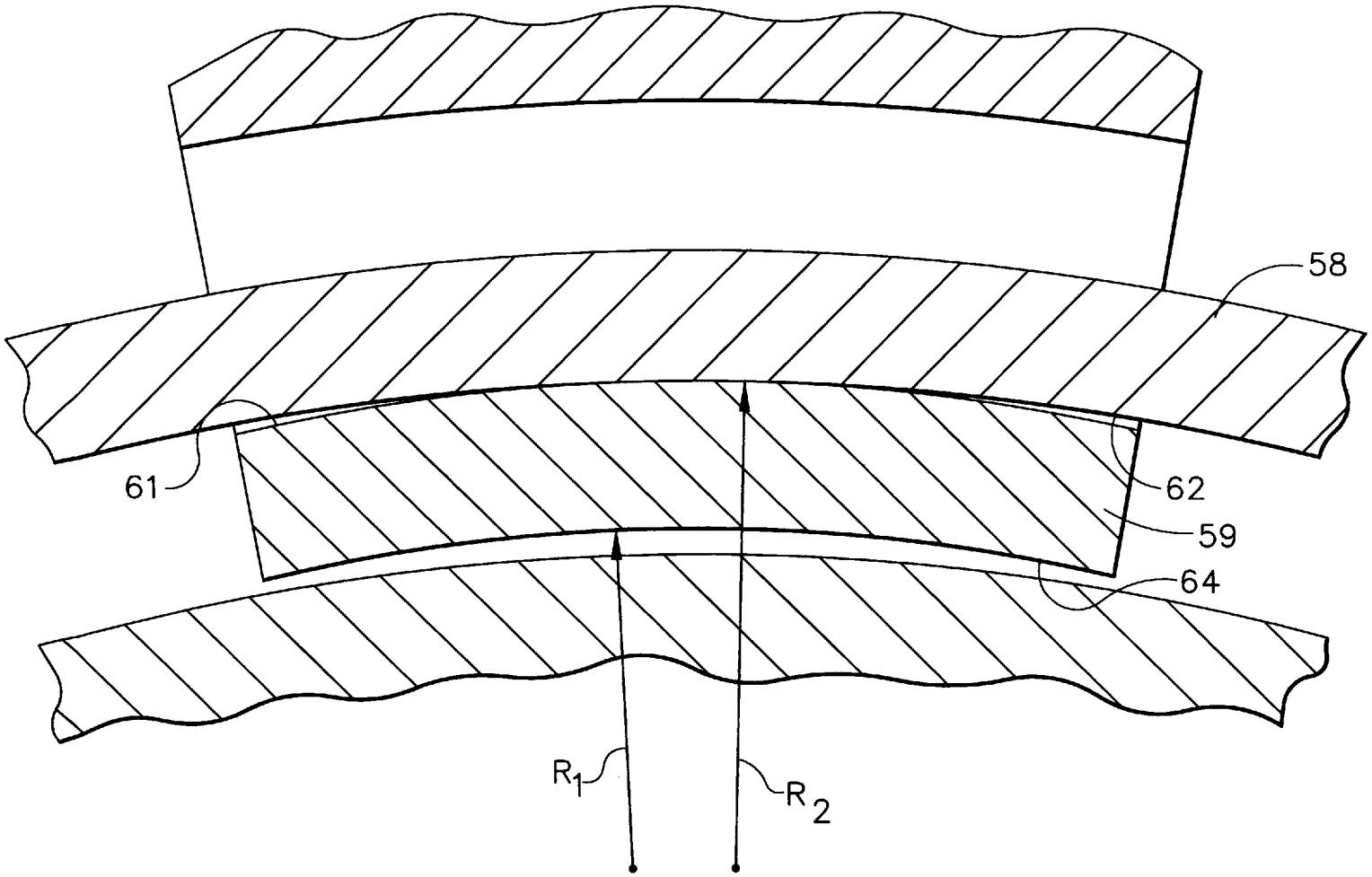
FIG. 4 is a partial cross-sectional view taken along line 4—4 in FIG. 2.

As best seen in FIG. 2, each centerbody segment 51 is retained in position by means of an interference fit with inner dome outer portion 28. More specifically, inner dome outer portion 28 includes a hook 58 into which a first or downstream flange member 59 extending from a bottom portion 60 of centerbody segment 51 is inserted. It will be noted that first flange member 59 is preferably constructed (i.e., tapered) so as to control a point of contact between a radially outer surface 61 of first flange member 59 and an inner surface 62 of hook 58. In order to maintain only one point of contact between radially outer surface 61 and hook inner surface 62 in a middle part of hook 58, radially outer surface 61 of such first flange member 59 is given a circumferential radius $R_1$ which is less than a circumferential radius $R_2$ of hook inner surface 62 (see FIG. 4). This permits the interference to attenuate through the entire circumferential length of first flange member 59 and provide a "softer" fit than if the interference were uniform for the entire first flange circumferential length. Moreover, first flange member 59 preferably includes a step 63 formed along a radially inner surface 64 thereof in order to better spread the load between first flange member 59 and hook 58. It will also be appreciated that the joint between first flange member 59 and hook 58 will become tighter when inner annular combustor 23 is off and outer annular combustor 24 is on (i.e., at pilot operation) since side walls 56 and 57 of centerbody segments 51 will tend to bend down circumferentially and downstream end 55 will tend to bend down radially when viewed in the axial and circumferential perspectives, respectively.

A second flange member 65 preferably extends upstream from centerbody segment bottom portion 60 and is designed to terminate adjacent an upstream area 29 of outer dome inner portion 25. It will be seen in FIGS. 2 and 3 that inner dome outer portion 28 preferably includes a flange 66 located upstream of hook 58 and second flange member 65 of centerbody segment 51 lies in abutting relationship with surface 67 of flange 66. Of course, at least one passage 68 is provided through inner dome outer portion 28 which aligns with a corresponding passage 69 into centerbody segment bottom portion 60 so that air can be introduced into an internal serpentine passage in centerbody segment top portion 49 for cooling purposes. A second pair of passages through inner dome outer portion 28 and the bottom portion of each centerbody segment 51 is preferred to help reduce pressure losses for a given amount of air required to cool the centerbody segment compared to a single inlet.

Figure 5:
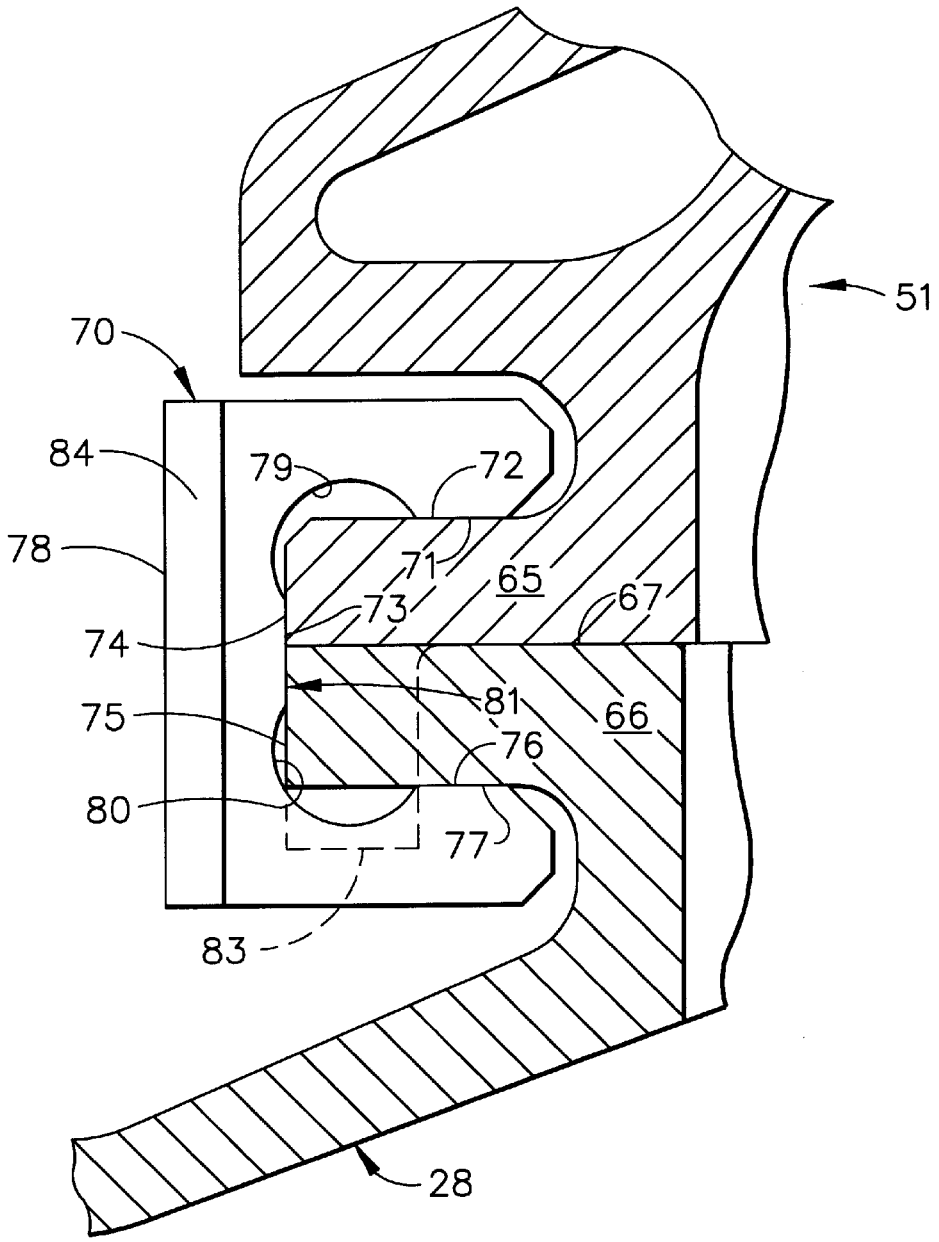
FIG. 5 is an enlarged partial view of FIG. 2 depicting the relationship of the C-clip 70, second flange member 65 and flange 66.

While it is believed that each centerbody segment 51 could be retained in position without it, a C-clip 70 is preferably provided (made up of individual C-clip segments for each centerbody segment) to clamp second flange member 65 of centerbody segment 51 to flange 66 of inner dome outer portion 28. As best seen in FIG. 5, C-clip 70 has a first point of contact along a first surface 71 with upper circumferential surface 72 of second flange member 65 and a second point of contact along a second surface 76 with a lower circumferential surface 77 of flange 66. C-clip 70 preferably has a third point of contact along a third surface 73 with a radial surface 74 of second flange member 65 and a radial surface 75 of flange 66 (see FIG. 3). In this way, centerbody segment 51 is retained in position radially and prevented from moving axially forward. It will be noted, then, that C-clip 70 has an upstream surface 78 which lies adjacent to downstream area 29 of outer dome inner portion 25 which prevents C-clip 70 from backing off second flange member 65 and flange 66. Although it is preferred that C-clip 70 provide a clamping fit between second flange member 65 of centerbody segment 51 and flange 66 of inner dome outer portion 28 in conjunction with the interference fit provided by hook 58 of inner dome outer portion 28 and first flange member 59 of centerbody segment 51, it is contemplated that utilization of C-clip 70 could make such interference fit unnecessary.

Further, C-clip 70 is designed to withstand large deflections with a relatively short arm length by incorporating large fillets 79 and 80 having a compound radius, as well as a land area 81 located therebetween which is able to maintain contact at third contact surface 73 with both second flange member radial surface 74 and flange radial surface 75 to accommodate shifting and sliding during engine operation. It will be understood by those skilled in the art that C-clip 70 spreads the clamp load over a broad surface and does not overload any one vulnerable area. This is a definite improvement over the use of mounting bolts or brazing in the prior art, which have a hard point or a concentrated load path in the bolt or brazing joint used to mount the centerbody.

Figures 6, 7:
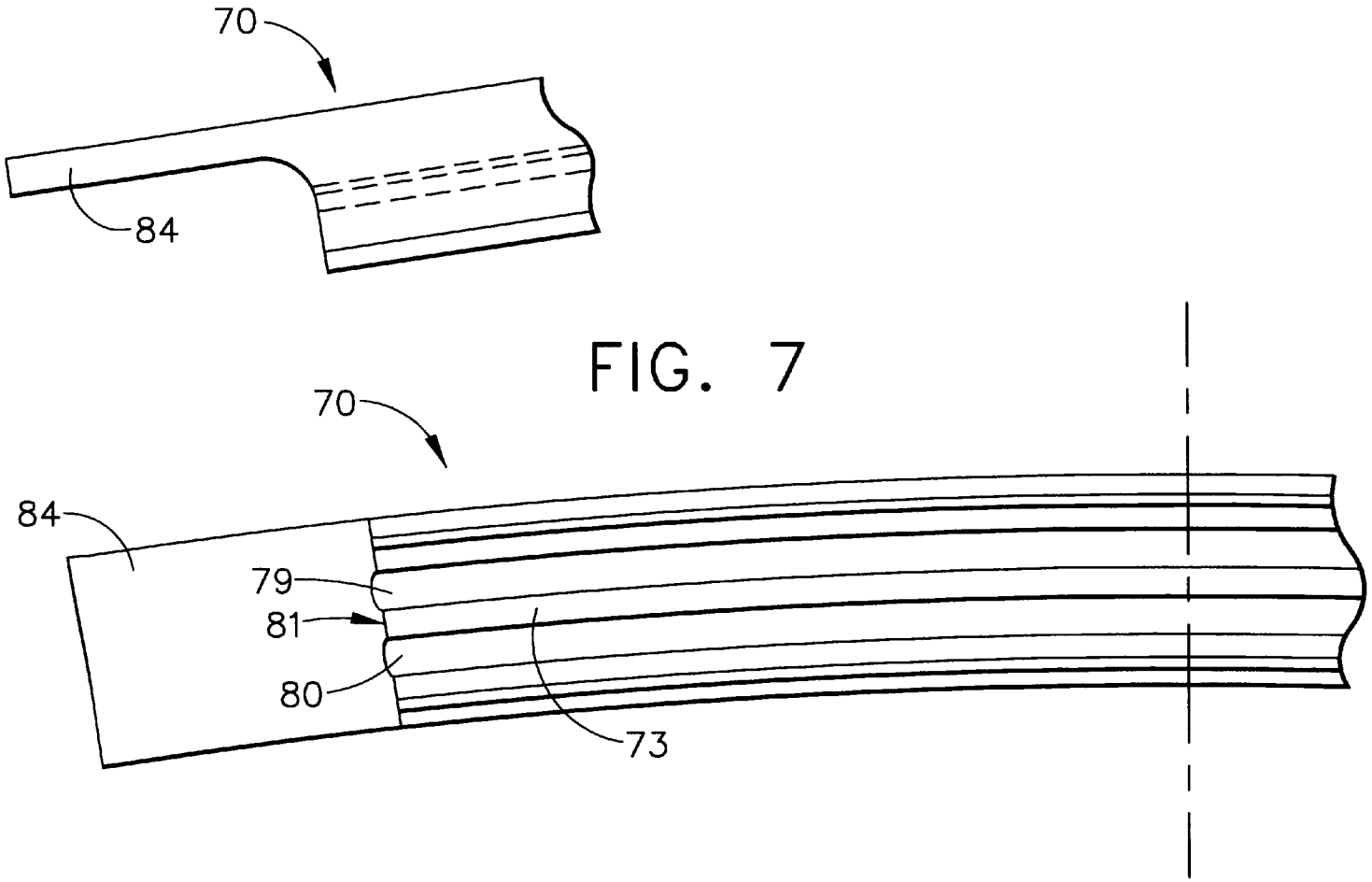
FIG. 6 is a partial aft looking forward view of the C-clip depicted in FIGS. 1–3 and 5.
FIG. 7 is a partial top view of the C-clip as depicted in FIG. 6.

As seen best in FIG. 3, inner dome outer portion 28 includes a plurality of circumferentially-spaced slots 82 (one of which is shown) in flange 66 and second flange member 65 includes circumferentially spaced tabs 83 which extend radially inward so as to properly locate centerbody segments 51 therearound. Accordingly, air inlet passages 69 of centerbody segments 51 are ensured to line up with air passages 68 in inner dome outer portion 28. In addition, tabs 83 of second flange member 65 are utilized to prevent centerbody segment 51 from being pushed too far axially aft during assembly, which could otherwise put excess strain on hook 58. C-clip 70 preferably includes a pair of end portions 84 on each side which align with a corresponding tab 83 and a portion of a corresponding slot 82 (see FIGS. 6 and 7) and therefore do not provide a clamping function. Accordingly, each C-clip segment is maintained in position circumferentially since tabs 83 extend radially inward of flange 66 and prevent the clamping portion of C-clip 70 from overlapping slot 82.

Contrary to previous designs, centerbody segments 51 of the present invention preferably are sized to extend circumferentially so that one such segment is provided for each fuel cup or carburetor. The split line between adjacent centerbody segments 51 preferably is at the centerlines of each fuel cup, thereby allowing the heated comers of centerbody segments 51 to move freely away from the colder central area of the part located between fuel cups and reducing the thermal stress imposed thereon.

In light of the foregoing description of centerbody 50 and the interference fit between inner dome outer portion 28 and outer dome inner portion 25, the process for inserting individual centerbody segments 51 thereof into position involves first aligning tabs 83 of second flange member 65 with slots 82 of flange 66. Then, first flange member 59 is placed in hook 58 and centerbody segment 51 is rotated downward so that second flange member 65 is in abutting relation with upper circumferential surface 67 of flange 66. In this way, the interference fit between centerbody segment 51 and inner dome outer portion 28 is established since a point of contact is obtained between radially outer surface 61 of first flange member 59 and inner surface 62 of hook 58. Thereafter, C-clip 70 is preferably positioned on second flange member 65 and flange 66 so as to provide the clamping fit therebetween. The final step is to attach outer dome inner portion 25 to inner dome outer portion 28 via a bolt and nut or other similar means at upstream ends thereof which lie in substantially abutting relation (see FIG. 1). Accordingly, downstream area 29 of outer dome inner portion 25 prevents C-clip 70 from backing off second flange member 65 and flange 66. Consequently, each centerbody segment 51 is retained in position between inner dome 21 and outer dome 22 by means of an interference fit and a clamping fit without regard to radial and axial influences.

In order to augment the cooling of centerbody 50, as well as the structure thereof, it is preferred that columns and/or pins extend between the interior surfaces of upper wall 52 and lower wall 53 as is known to provide a serpentine cooling passage therein. It is also preferred that centerbody segments 51 be metallic so as to permit the spring effect desired between first flange member 59 and hook 58, although any material consistent with this desired function is acceptable.

Disposed in outer annular combustor 24 is a plurality of circumferentially spaced carburetor devices 30 with their axes being coincident with that of outer annular combustor 24 and aligned substantially with outer liner 13 to present an annular combustor profile which is substantially straight. It should be understood that carburetor device 30 can be of any of various designs which acts to mix or carburet the fuel and air for introduction into combustion chamber 12. One design might be that shown and described in U.S. Pat. No. 4,070,826, entitled "Low Pressure fuel Injection System," by Stenger et al., and assigned to the assignee of the present invention. In general, carburetor device 30 receives fuel from a fuel tube 31 through fuel nozzle 33 and air from annular opening 15, with the fuel being atomized by the flow of air to present an atomized mist of fuel to combustion chamber 12.

In a manner similar to outer annular combustor 24, inner annular combustor 23 includes a plurality of circumferentially spaced carburetor devices 32 whose axes are aligned substantially parallel to the axis of carburetor device 30. Carburetor devices 32, together with inner dome plate 22, inner liner 14 and centerbody 50 define inner annular combustor 23 which may be operated substantially independently from outer annular combustor 24 as mentioned hereinabove. Once again, the specific type and structure of carburetor device 32 is not important to the present invention, but should preferably be optimized for efficiency and low emissions performance. For description purposes only, and except for considerably higher airflow capacity, carburetor device 32 is identical to carburetor device 30 and includes a fuel nozzle 34 connected to fuel tube 31 for introducing fuel which is atomized by high pressure or introduced in a liquid state at a low pressure. A primary swirler 35 receives air to interact with the fuel and swirl it into venturi 36. A secondary swirler 37 then acts to present a swirl of air in the opposite direction so as to interact with the fuel/air mixture to further atomize the mixture and cause it to flow into combustion chamber 12. A flared splashplate 38, which preferably is integral with the swirl cup, is employed at the downstream end of carburetor device 32 so as to prevent excessive dispersion of the fuel/air mixture. This integral splashplate/swirl cup 38 is the subject of U.S. Pat. No. 5,321,951, which is also owned by the assignee of the present invention and is hereby incorporated by reference herein.

Considering now the operation of the above-described double annular combustor, outer annular combustor 24 and inner annular combustor 23 may be used individually or in combination to provide the desired combustion condition. Preferably, outer annular combustor 24 is used by itself for starting and low speed conditions and will be referred to as the pilot stage. The inner annular combustor 23 is used at higher speed, higher temperature conditions and will be referred to as the main stage combustor. Upon starting the engine and for idle condition operation, carburetor devices 30 are fueled by way of fuel tubes 31, and pilot stage 24 is ignited by way of igniter 39. The air from diffuser 19 will flow as shown by the arrows, both through active carburetor devices 30 and through inactive carburetor devices 32. During these idle conditions, wherein both the temperatures and airflow are relatively low, pilot stage 24 operates over a relatively narrow fuel/air ratio band and outer liner 13, which is in the direct axial line of carburetor devices 30, will see only narrow excursions in relatively cool temperature levels. This will allow the cooling flow distribution in apertures 20 to be maintained at a minimum. Further, because outer annular combustor 24 and inner annular combustor 23 lie in distinct axial planes, pilot stage 24 is relatively long as compared with main stage 23 and the residence time will preferably be relatively long to thereby minimize the amount of hydrocarbon and carbon monoxide emissions.

As the engine speed increases, fuel is introduced by fuel tube 31 into carburetor devices 32 through fuel nozzles 34 so as to activate main stage 23. During such higher speed operation, pilot stage 24 remains in operation but main stage 23 consumes the majority of the fuel and the air. It will be recognized that main stage 23 is axially short in length when compared with pilot stage 24 due to the axial offset therebetween, whereby the residence time will be relatively short to reduce the NOx emissions.

Having shown and described the preferred embodiment of the present invention, further adaptations of the double annular combustor, and particularly the inner and outer domes thereof, can be accomplished by appropriate modifications by one of ordinary skill in the art without departing from the scope of the invention. It will also be appreciated that the manner of retaining a centerbody disclosed herein is applicable to any multiple annular combustor having radially adjacent domes.

What is claimed is:

1. A double annular combustor having concentrically disposed inner and outer annular combustors, comprising:

(a) an inner dome including an inner portion and an outer portion;

(b) an outer dome including an inner portion and an outer portion, wherein said outer dome inner portion is connected to said inner dome outer portion; and (c) a substantially annular centerbody disposed between said inner dome and said outer dome, said centerbody further comprising a plurality of structurally independent arcuate segments having a top portion extending substantially downstream so as to isolate said inner and outer combustors and a bottom portion including a first flange member extending downstream, wherein each said centerbody segment is retained in position via an interference fit between said first flange member and said inner dome outer portion.

2. The double annular combustor of claim 1, wherein said inner dome is located axially downstream of said outer dome.

3. The double annular combustor of claim 1, said inner dome outer portion including a hook area, wherein said first flange member of each said centerbody segment is located therein.

4. The double annular combustor of claim 3, wherein said first flange member is tapered so as to control a point of contact between said first flange member and an inner surface of said hook area.

5. The double annular combustor of claim 4, wherein said first flange member includes a radially outer surface having a circumferential radius less than said inner surface of said hook area so that only one point of contact exists therebetween.

6. The double annular combustor of claim 4, wherein said first flange member includes a step formed along a radially inner surface thereof.

7. The double annular combustor of claim 1, said centerbody segment bottom portion further including a second flange member extending upstream therefrom and said inner dome outer portion further including a flange extending substantially parallel to said second flange member of each said centerbody segment, wherein a radially inner surface of said second flange member is positioned to lie in substantially abutting relation to a radially outer surface of said inner dome outer portion flange.

8. The double annular combustor of claim 7, said flange of said inner dome outer portion including a plurality of spaced slots formed at an upstream edge thereof.

9. The double annular combustor of claim 8, said second flange member including at least one tab extending radially inward so as to engage one of said slots formed in said inner dome outer portion flange, wherein each said centerbody segment is properly positioned circumferentially and axially.

10. The double annular combustor of claim 8, further comprising a clamp for retaining said second flange member to said inner dome outer portion flange.

11. The double annular combustor of claim 10, said clamp being substantially C-shaped in configuration.

12. The double annular combustor of claim 10, said clamp providing a first point of contact along a first surface with an upper circumferential surface of said second flange member and a second point of contact along a second surface with a lower circumferential surface of said inner dome outer portion flange.

13. The double annular combustor of claim 12, said clamp further comprising a pair of fillets formed into an inner surface thereof having a compound radius and a land area therebetween.

14. The double annular combustor of claim 13, said land area being sized so as to provide a third point of contact with at least a portion of a radial surface of said second flange member and a radial surface of said inner dome outer portion flange.

15. The double annular combustor of claim 10, wherein an outer upstream surface of said clamp is positioned adjacent said outer dome inner portion so that said clamp is unable to back off said second flange member and said inner dome outer portion flange.

16. The double annular combustor of claim 10, said clamp including a pair of end portions aligned with respective slots formed in said inner dome outer portion flange which do not provide a clamping function.

17. A double annular combustor having concentrically disposed inner and outer annular combustors comprising:

(a) an inner dome including an inner portion and an outer portion, said inner dome outer portion including a flange extending substantially upstream therefrom;

(b) an outer dome including an inner portion and an outer portion, wherein said outer dome inner portion is connected to said inner dome outer portion; and (c) a substantially annular centerbody disposed between said inner dome and said outer dome, said centerbody further comprising a plurality of structurally independent arcuate segments having a top portion extending substantially downstream so as to isolate said inner and outer combustors and a bottom portion including first flange member extending upstream, wherein each said centerbody segment is retained in position via a clamping fit between said first flange member and said flange of said inner dome outer portion.

18. The double annular combustor of claim 17, further comprising a clamp for retaining said first flange member to said inner dome outer portion flange.

* * * * *